US008882238B2

(12) United States Patent
Minamino et al.

(10) Patent No.: US 8,882,238 B2
(45) Date of Patent: Nov. 11, 2014

(54) COATING DEVICE

(75) Inventors: Daiki Minamino, Tokyo (JP); Tadatsugu Okumura, Tokyo (JP); Ichiro Miyagawa, Tokyo (JP); Tomohiko Sakai, Tokyo (JP); Naoki Shimizu, Osaka (JP); Kiyoshi Akagi, Tokyo (JP)

(73) Assignee: Konica Minolta Opto, Inc., Tokyo (JP)

( * ) Notice: Subject to any disclaimer, the term of this patent is extended or adjusted under 35 U.S.C. 154(b) by 1378 days.

(21) Appl. No.: 12/602,782

(22) PCT Filed: May 15, 2008

(86) PCT No.: PCT/JP2008/058940

§ 371 (c)(1),
(2), (4) Date: Dec. 3, 2009

(87) PCT Pub. No.: WO2008/149652

PCT Pub. Date: Dec. 11, 2008

(65) Prior Publication Data

US 2010/0171786 A1 Jul. 8, 2010

(30) Foreign Application Priority Data

Jun. 6, 2007 (JP) ..... 2007-150259

(51) Int. Cl.

| | |
|---|---|
| ***B41J 2/015*** | (2006.01) |
| ***B41J 3/54*** | (2006.01) |
| ***B41J 11/00*** | (2006.01) |

(52) U.S. Cl.

CPC ..... *B41J 3/543* (2013.01); *B41J 11/0015* (2013.01); *B41J 2202/21* (2013.01)

USPC ..... 347/20

(58) Field of Classification Search

CPC .... B41J 3/543; B41J 11/0015; B41J 2202/21; B05B 17/0638; B05B 17/0646

USPC ..... 347/20, 88, 99, 101, 103; 118/300, 118/313–315, 325; 427/466, 511

See application file for complete search history.

(56) References Cited

U.S. PATENT DOCUMENTS

2007/0035569 A1 * 2/2007 Koto et al. ..... 347/14

FOREIGN PATENT DOCUMENTS

| | | |
|---|---|---|
| JP | 2000-141687 | 5/2000 |
| JP | 2003-118135 | 4/2003 |
| JP | 2004-122112 | 4/2004 |
| JP | 2004-223356 | 8/2004 |
| JP | 2006-069176 | 3/2006 |
| JP | 2006-281176 | 10/2006 |
| JP | 2007-055069 | 3/2007 |
| JP | 2007150259 | 6/2007 |

* cited by examiner

*Primary Examiner* — Manish S Shah
*Assistant Examiner* — Roger W Pisha, II
(74) *Attorney, Agent, or Firm* — Lucas & Mercanti, LLP

(57) ABSTRACT

A coating device is provided with: a plurality of inkjet heads (31) staggered to cover an area to be coated in a width direction of a long-roll supporting body (10); a pressure adjusting mechanism (40) for adjusting the back-pressure of the coating solution to be applied from inkjet heads (31); a plurality of solution feeding pipes (43) for supplying the coating solution from the pressure adjusting mechanism (40) to inkjet heads (31); and storage tank (50) for storing the coating solution, wherein the feeding volumes of the coating solution from the solution feeding pipes (43) are adjusted equal (i.e. flow resistances of the piping are made equal), so that equal back-pressures are applied to the coating solution to be jetted from the inkjet heads.

9 Claims, 4 Drawing Sheets

COATING DEVICE

TECHNICAL FIELD

The present invention relates to a coating device using a solution ejecting method, which forms a coated film on a long-roll supporting body, being continuously conveyed, and in particular, to a coating device which conducts a coating operation, using an inkjet method.

BACKGROUND OF THE INVENTION

Image formations and various methods to form coated film, including a patterned coated film on the supporting body, using the inkjet methods, are well known. An inkjet head, being used in the inkjet methods, incorporates a plurality of nozzles to jet ink onto the supporting body, and forms a desired image or the coated film onto the supporting body, based on printing data.

The above described inkjet operation is to jet minute ink droplets from the nozzles onto the supporting body by a piezoelectric element, a heater, or the like. For example, the piezoelectric element is mounted on the nozzle, whereby the piezoelectric element is controlled to change its shape, due to an applied electrical driving voltage. That is, since the shape of the piezoelectric element is changed by the applied electrical driving voltage, an ink channel is compressed so that the ink droplet is discharged from the nozzle.

In the present Specification, said "ink" is equal to "coating solution", and "to print" is equal to "to coat" in their meanings.

As the methods to form the above described image and coated film on the supporting body exhibiting the wide range, well known are a serial type method which conducts the coating operation while the inkjet heads are controlled to move in a conveyance direction or a width direction of the supporting body, and a line-type method which conducts the coating operation while the plurality of the inkjet heads are configured to be mounted in the width direction of the supporting body. Specifically, concerning said line-type method, the plurality of the inkjet heads are provided to cover the intended coating width of the supporting body, in parallel to the width direction of the supporting body.

To form the coated film on the long-roll supporting body, which is continuously conveyed, the above described line-type method does not need to scan the supporting body in a so-called sub-scanning direction of the inkjet heads, whereby the accuracy of landing positions of the coating solution can be improved. Further, the coating speed can be increased.

Various products, which are produced after the coated film have been formed on the continuously conveyed long-roll supporting body, are not limited to specific members, so that the above various products include, silver halide photosensitive members for general use and the industrial uses, heat sensitive members, heat development photosensitive members, and devices for electro-optical panels including photoresist, LCD and organic EL. Concerning the devices for the electro-optical panels, listed is an optical film, on which an antireflective layer is formed, to be attached on the front surface of a display device, in order to more clearly view images through a CRT or a liquid crystal display device. However, concerning the large screen display devices, such as a television device, said screen tends to be easily scratched by something undesired. To overcome this problem, a hard-coat layer is formed on the supporting body, and the antireflective layer is formed on said hard-coat layer, whereby an antireflective film, including the hard-coat layer on the antireflective layer, is produced. Said optical film is requested to exhibit a very accurate thickness of the coated film, because any distortion of the transmitted light or any distortion of the reflected light must be extremely even, as well as that the amount of transmitted light must be extremely even. Specifically, in the case of the antireflective film, due to the optical interference of beams of light, reflected on an upper surface of the coated film, and beams of light, reflected on a lower surface of the coated film, the incident light is attenuated so that the amount of reflected light is reduced, whereby the power of antireflection depends upon the thickness of the coated layer while the thickness of the coated layer is based on the wave length of the incident light. That is, higher evenness of the coated film results in higher quality of the antireflective layer.

However, in a case of the jetting operation of ink droplets as the inkjet method, conditions while letting the ink droplets tend to vary, which conditions depend upon the pressure at a time just before the ink enters the inkjet heads. That is, said conditions depend upon the back-pressure on the ink. If the back-pressure is abnormally high, the volume of ink droplets to be jetted increases, whereby a satellite area of each deposited ink droplet increases, and the nozzle plate supporting the nozzles tends to be quickly stained. Further, an extraordinarily high back-pressure causes abnormal leakage of ink droplets during non-jetting condition, which also stains the nozzle plate, as well as abnormal dripping of ink droplets. On the other hand, if the back-pressure is relatively low, the jetted volume of ink droplets decreases, and the ink jetting operation becomes unstable, and if the back-pressure is extraordinarily low, the ink jetting operation tends to become difficult, though the piezoelectric element may be working well.

Still further, the back-pressure is configured to be equal to or slightly less than the atmospheric pressure. Due to this configuration, the above described satellite area and dripping of ink droplets during the non-jetting condition are prevented, so that staining of the nozzle plate and dripping of ink droplets can be decreased. Due to these positive results, coating defects, such as a continuing streak or the like, can be prevented.

Specifically, concerning the above described line-type coating device, the coating operation tends to be continued for a long duration. During such duration, the inkjet heads can not be cleaned easily, so that any defective back-pressure results in a continuing streak. Accordingly, an adequate amount of pressure should be applied to the coating solution in the inkjet heads, so that the ink droplets can be stably jetted.

Concerning the back-pressure, a coating device is disclosed (see Patent Document 1), in which the level of solution, stored in a solution tank (which is a solution feeding tank), is maintained to be at a predetermined level, which is lower than the level of the nozzle surfaces of the inkjet heads, whereby the predetermined level, that is, the level of the nozzle surfaces and the level of the head of solution stored in the solution tank are controlled by level sensors to be constant (See Patent Document 1).

Patent Document 1: Unexamined Japanese Patent Application Publication No. 2004-223356.

DISCLOSURE OF THE INVENTION

Problems to be Solved by the Present Invention

In Patent Document 1, the level of the head of the solution stored in the solution tank and the solution level of the nozzle surfaces are controlled by level sensors to be constant, so that the back-pressure of the coating solution in the inkjet head is controlled to be constant, and the solution tank is used as a pressure adjusting mechanism to adjust the back-pressure.

In the line-type coating device, in which a plurality of inkjet heads are mounted across the width of the supporting body, the coating solution is sent to the plurality of the inkjet heads through solution feeding pipes. When solution droplets are to be jetted, the pressure on the solution droplets, which is at the time just before the solution droplets enter the inkjet heads, that is, the back-pressure becomes lower than the pressure at the non-jetting time, due to the fluid resistance in the solution feeding pipes. Accordingly, in Patent Document 1, even though the pressure adjusting mechanism, provided on or downstream the solution feeding tanks, is configured to control the solution pressure, the pressure, being the back-pressure, at the time just before the solution droplets enter the inkjet heads, varies in each inkjet head, due to the individual fluid resistance generated by their different lengths (hereinafter referred to as "piping lengths") of the solution feeding pipes, provided for individual inkjet heads.

Further, in the line-type coating device, the coating width to be coated by a single inkjet head is shorter than the external size of the inkjet head. In order to coat the supporting body with no spaces between, a plurality of inkjet heads should be staggered, perpendicular to the conveyance direction of the supporting body. Concerning said staggered arrangement of the inkjet heads, if the jetting direction is not vertically downward, or not vertically upward, the height of each line of staggered arrangement differs. Due to this difference, a plurality of pressure adjusting devices are typically employed.

The above described "height" means height in the direction of gravitational force. For example, the height of the inkjet head, compared to the pressure adjusting mechanism means the height measured in the direction of gravitational force.

The present invention has been conceived to overcome the above problem. An object of the present invention is to offer a coating device exhibiting a simple structure, which can produce stable coating, while applying adequate back-pressure onto the coating solution in the plural inkjet heads, staggered to cover all the coating area in the width direction of the long-roll supporting body.

Means to Solve the Problems

The above described object will be attained by the structures detailed below.

Item 1. A coating device, using an inkjet method to jet droplets of a coating solution onto a long-roll supporting body, which body is continuously conveyed, and forming a coated film thereon, including:

- a plurality of inkjet heads which are arranged to cover an area to be coated in a width direction of the long-roll supporting body;
- a pressure adjusting mechanism which is configured to adjust back-pressure of the coating solution in the plurality of inkjet heads;
- a plurality of solution feeding pipes which supply the coating solution from the pressure adjusting mechanism to the plurality of the inkjet heads; and
- a storage tank which is configured to store the coating solution,
- wherein in the plurality of solution feeding pipes, connected to the plurality of inkjet heads, a feeding volume of coating solution in each pipe is configured to be equal to each other.

Item 2. The coating device described in item 1, wherein lengths of the plurality of solution feeding pipes, connected to the plurality of the inkjet heads, are equal to each other.

Item 3. The coating device described in item 1 or 2, wherein the plurality of inkjet heads are staggered perpendicular to the conveyance direction of the long-roll supporting body.

Item 4. The coating device described in any one of items 1-3, wherein the lengths of the plurality of solution feeding pipes, each connected to one of the plurality of inkjet heads, are arranged to be equal to each other, and while the plurality of inkjet heads are arranged in the same height compared to the pressure adjusting mechanism.

Item 5. The coating device described in any one of items 1-4, wherein the plurality of solution feeding pipes, being provided between the pressure adjusting mechanism and the plurality of inkjet heads, are sequentially branched between the pressure adjusting mechanism and the plurality of inkjet heads, so that the plurality of solution feeding pipes are connected to the plurality of inkjet heads, individually.

Item 6. The coating device described in any one of items 3-5, wherein the plurality of inkjet heads are arranged at different heights compared to the pressure adjusting mechanism in each line of the staggered arrangement in the width direction of the long-roll supporting body, and the lengths of the solution feeding pipes are configured to differ each other in each line of the inkjet heads.

Item 7. The coating device described in any one of items 1-3, wherein a diameter of each of the solution feeding pipes is determined based on the length of the solution feeding pipes which are from the pressure adjusting mechanism to the inkjet heads.

Item 8. The coating device described in item 6, wherein the diameter of each of the solution feeding pipes is determined based on a length of each of the solution feeding pipes which are measured from the pressure adjusting mechanism to the inkjet heads, and further determined based on a height of each line of the staggered arrangement of the inkjet heads.

Item 9. The coating device described in any one of items 1-8, wherein the pressure adjusting mechanism includes a solution feeding pipe to temporarily keep the coating solution, so that the pressure adjusting mechanism controls the back-pressure of the coating solution in the inkjet head, by an adjustment of the height of coating solution in the solution feeding tank.

Item 10. The coating device described in any one of items 1-8, wherein the pressure adjusting mechanism includes the solution feeding tank to temporarily keep the coating solution, and controls an air pressure in the solution feeding tank, so that the pressure adjusting mechanism controls the back-pressure of the coating solution in the inkjet head.

Item 11. The coating device described in any one of items 1-8, wherein the pressure adjusting mechanism controls a solution feeding pump, which is provided on the solution feeding pipe to supply coating solution from the solution storage tank to each inkjet head, so that the pressure adjusting mechanism controls the back-pressure of the coating solution in the inkjet head, while using the solution feeding pump.

Effects of the Invention

Based on the above described structures, an individual volume of coating solution to be fed to the inkjet heads, is controlled to be equal, wherein through the solution feeding pipes, the coating solution is sent to the plurality of inkjet heads, each mounted at equal height compared to the pressure adjusting mechanism. Accordingly, the back-pressure on the coating solution in the plurality of the inkjet heads is uniform. Further, concerning the inkjet heads, which are staggered, and exhibit different heights compared to the pressure adjusting mechanism with respect to each line of the staggered inkjet heads, the differences between the height of all inkjet heads is corrected to be equal, so that the volume of solution to be fed is controlled to be equal, whereby the back-pressure of each of the plurality of inkjet heads is controlled to be equal. Due to this configuration, when the inkjet heads are controlled to jet coating solution onto the long-roll supporting body, which is continuously conveyed, appropriate back-pressure can be applied onto the coating solution in each inkjet head, so that the constant and adequate coating operation can be conducted.

EXPLANATIONS OF THE NUMERAL IDENTIFICATIONS

Figure 1:
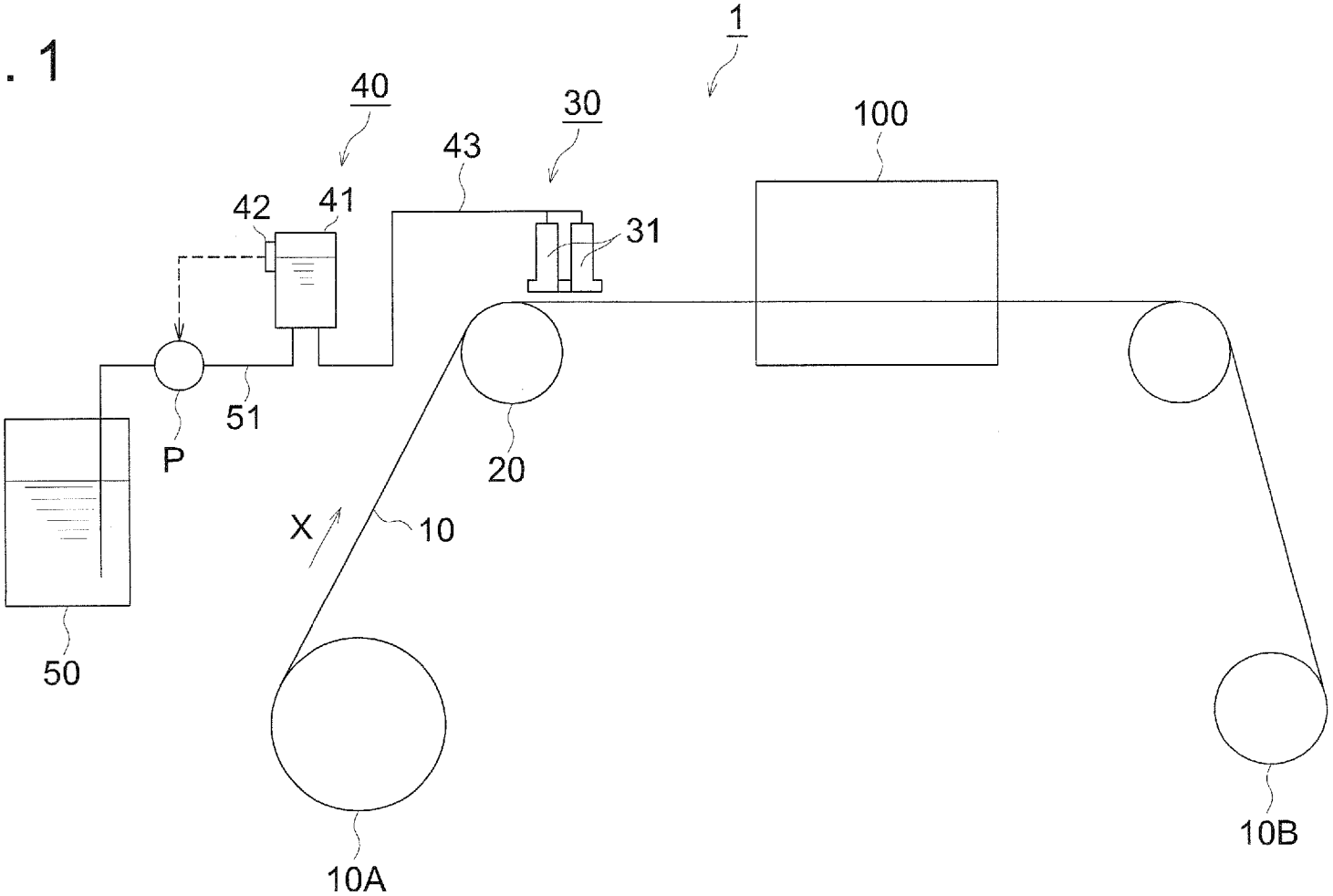
FIG. 1 is a schematic drawing to show a structure of a line-type coating device.

1 coating device
10 supporting body
10A supply roll
10B take-up roll
20 backing roller
30 inkjet head unit
31 inkjet heads
40 pressure adjusting mechanism
41 solution feeding tank
42 solution level sensor
43 solution feeding pipe
45 solution feeding valve
46 solution wasting valve
47 waste solution tank
50 storage tank
51 supplying pipe
100 dryer section
P solution feeding pump

PREFERRED EMBODIMENT OF THE INVENTION

Embodiments of the present invention will now be detailed while referring to the figures, however the present invention is not limited to these Embodiments.

Equality of the length of the pipes (which is a length of the solution feeding pipes) cannot be precisely determined, due to the various levels of the necessary accuracy of the coating members. For example, in a case of an optical film, such as an antireflective film, requiring a very high degree of accuracy of its finished coated condition, an error range of 5 mm for a piping length of 1 m as the standard length, is considered to represent equality of length. However, an error range of 1 mm is more preferable. Further, concerning the error range of the diameter of the pipes having an equal diameter, an allowable range is 5% of the standard diameter of the pipes. However, an error range of 1% is more preferable.

FIG. 1 is the schematic drawing showing the structure of line-type coating device 1.

Long-roll supporting body 10 is unwound from supply roll 10A to be conveyed in arrowed direction X, by a driving means, which is not illustrated.

Long-roll supporting body 10 is entrained about backing roller 20 for support and conveyance. The coating solution is jetted onto said supporting body 10 from inkjet head unit 30, whereby the coating solution is applied onto said supporting body 10. Inkjet unit 30 includes a plurality of inkjet heads 31 to cover the coating area in the width direction of said supporting body.

Figure 2:
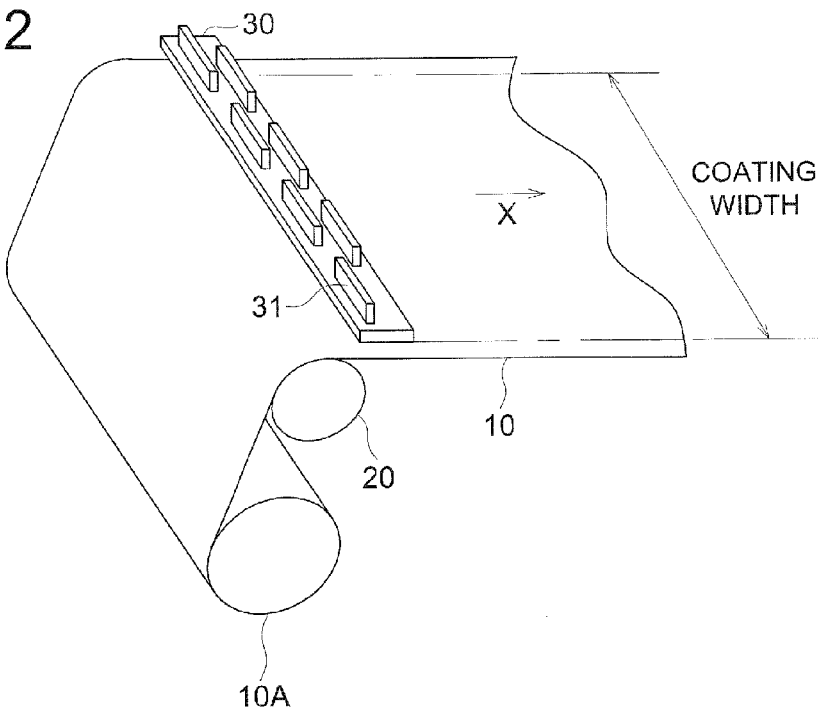
FIG. 2 shows an example of inkjet heads, being arranged.
Figure 3:
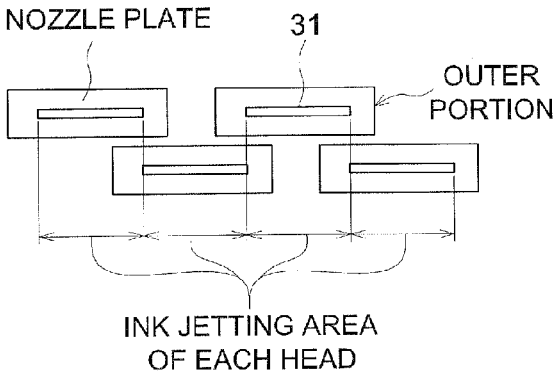
FIG. 3 shows a positional relationship of the inkjet heads arranged to be staggered.

FIG. 2 shows an example of the staggered arrangement of inkjet heads 31 of inkjet head unit 30. Further, said figure shows an example in which all of inkjet heads 31 are arranged to be in equal height compared to pressure adjusting mechanism 40. As described above, since the coating width (being the jetting width) of a single inkjet head is less than the outer size of the single inkjet head, the plurality of the inkjet heads are staggered with no space between, perpendicular to the conveyance direction of the supporting body, so that ink particles can be jetted onto the total necessary printing area in the width direction of the supporting body. In the example shown in FIG. 2, two lines of the staggered arrangements are shown, so that the necessary coating width is covered. FIG. 3 shows the relationship among the outer shape, the jetting width, and the staggered arrangement, of inkjet head 31. Since the number of inkjet heads 31 and the number of lines of the staggered arrangement are appropriately determined, based on the jetting width, or the coating width of the inkjet head 31, the above numbers are not limited to the example in FIG. 2.

Coating solution is supplied to each inkjet head 31 from a pressure adjusting mechanism, which controls the back-pressure on the coating solution, through solution feeding pipe 43. Specifically, in the figure, solution feeding pipes 43 represents a plurality of the pipes.

Solution feeding pump P, provided between storage tank 50 and supplying pipe 51, feeds the coating solution to pressure adjusting mechanism 40.

Materials of solution feeding pipe 43 and supplying pipe 51 are not limited to any special material, and the only required quality is corrosion resistance against the coating solution. For example, a metallic pipe, such as stainless steel, or plastic can be used. In the present embodiments, a fluorine resin pipe is used.

The supporting body, on which the coating film has been formed, is dried in dryer section 100, and is taken up by take-up roller 10B.

Adjustment of back-pressure, conducted by pressure adjusting mechanism 40, will be detailed below.

Pressure adjusting mechanism 40 includes solution feeding tank 41 to temporarily store the coating solution, whereby the back-pressure of the coating solution in inkjet heads 31 is exactly adjusted, due to control of the height of the level of the solution in solution feeding tank 41. The height of the level of the solution in solution feeding tank 41 is detected by solution level sensor 42, and the volume of solution being fed from storage tank 50 is exactly controlled, due to the control of solution feeding pump P, whereby the height of solution in feeding tank 41 is maintained at a constant level. Accordingly, the back-pressure is maintained at a predetermined value. Concerning types of solution level sensor 42, listed are a laser displacement detector, a solution position measuring sensor, such as a float-type sensor, and a mass sensor to detect the mass of the coating solution in solution feeding tank 41.

Concerning the control of the back-pressure, air under pressure is sent in solution feeding tank 41, so that the inner pressure of solution feeding tank 41 is exactly controlled. Alternatively, solution feeding pump P is used instead of pressure adjusting mechanism 40, so that solution feeding pump P is exactly controlled.

Well known types of pumps, such as a geared pump, a plunger pump, or a diaphragm pump, may be used as solution feeding pump P.

However, as described above, since the coating solution is sent to the plurality of inkjet heads 31 from pressure adjusting mechanism 40 through the plurality of solution feeding pipes 43, the solution pressure just prior to entering the inkjet head is varied, that is, the back-pressure adversely is varied in each inkjet head 31, which is a major problem. Due to this variance, a stable coating operation cannot be conducted.

Figure 4:
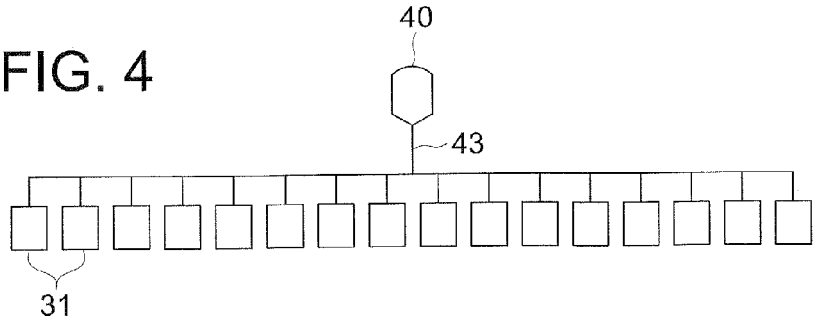
FIG. 4 is a schematic drawing of a piping pattern, having different fluid resistances.

This problem occurs due to the different fluid resistance in each solution feeding pipe 43. That is, if the fluid resistance differs, the feeding volume of the coating solution proportionally differs. FIG. 4 is a schematic drawing of a piping pattern, having largely differing fluid resistances. Solution feeding pipe 43 of inkjet head 31, which is close to the pressure adjusting mechanism 40, is relatively short, so that the fluid resistance is relatively low, while solution feeding pipe 43 of inkjet head 31, which is relatively far from the pressure adjusting mechanism 40, is relatively long, so that the fluid resistance is relatively high.

In solution feeding pipe 43 of coating device 1 in FIG. 1, the volume of solution to be fed to the plurality of the inkjet heads, being arranged at an equal height compared to pressure adjusting mechanism 40, is controlled to be equal (which means that the fluid resistance is equal to each other), whereby, equal back-pressure can be applied.

An example for adjusting the feeding volume of coating solution is detailed below.

Adjustment Example 1

Figure 5:
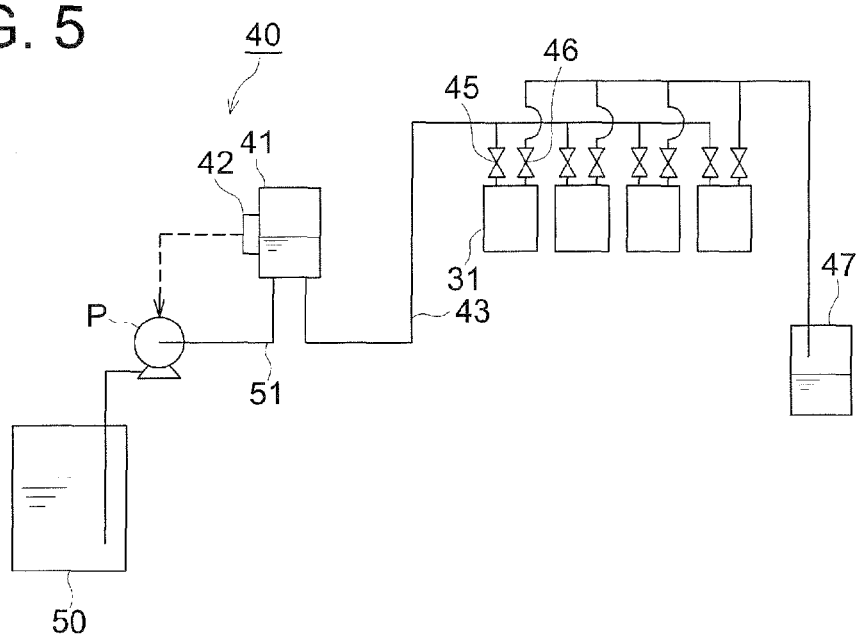
FIG. 5 is a schematic drawing to show an example of methods to control the feeding volume of solution.

FIG. 5 shows an example of the adjustment method of the solution feeding volume. Said feeding volume is adjusted by solution feeding valve 45 which is able to change the solution feeding volume, which is mounted in mid-flow of solution feeding pipe 43, and is adjacent to inkjet head 31. The solution feeding volume is adjusted by a way shown below. That is, firstly, solution feeding pipe 43 is disconnected from inkjet head 31, but the height of a joining portion of pipe 43 to join inkjet head 31 is not changed, after that, pressure adjusting mechanism 40 is activated to increase the solution pressure, so that the coating solution is ejected from pipe 43, then the solution feeding volume can be measured. By this measurement, the solution feeding volume of each pipe 43 is adjusted to be equal.

Concerning said solution feeding volume, the relationship is experimentally obtained, which is between the solution feeding volume and the coated film (that is, the thickness of the coated film), coated by inkjet head 31. An optimum solution feeding volume to generate a desired coated film is then determined. As another method, while each inkjet head 31 is activated to jet the coating solution, the solution feeding volume is controlled to obtain the desired thickness of the coated film.

By the above methods, the optimum back-pressure of the coating solution in each inkjet head 31 is determined.

Solution wasting valve 46 is used, when the coating solution is previously ejected to waste solution tank 47. Because air bubbles must be ejected, when the coating solution is filled in inkjet head 31.

Adjusting Example 2

When the coating solution is flown into the pipes, the coating solution generally flows as the laminar flow, in pipe 43 which is between pressure controlling mechanism 40 and inkjet head 31. If the bend of the pipe as well as the expansion and contraction is not considered, flow resistance ΔP in the pipe is determined by a formula shown below.

$$\Delta P=(128\mu LQ)/(\pi D^4) \quad \text{(Formula 1)}$$

where

"μ" represents the viscosity of the coating solution;

"L" represents the length of the pipe;

"Q" represents the volume of the solution to be fed; and

"D" represents the inner diameter of the pipe.

Accordingly, in a case that the inner diameter of solution feeding pipe 43 is constant and pipe 43 is made of an equal material, if the lengths of solution feeding pipes 43, which are from pressure controlling mechanism to each inkjet head, are made to be equal, the flow resistances of solution feeding pipes 43 can be equal each other, that is, the solution feeding volume can be equal in each pipe 43.

FIG. 6 is the schematic drawing of the piping example, in which the length of solution feeding pipe 43 for each inkjet head is equal to each other. FIG. 6(*a*) shows a piping example in which the plurality of solution feeding pipes 43 are branched from pressure controlling mechanism 40, and connected to inkjet heads 31. FIG. 6(*b*) shows a piping example in which solution feeding pipes 43 are sequentially separated, and connected to inkjet heads 31. Comparing the piping examples shown in FIG. 6(*a*) and FIG. 6(*b*), the piping example of FIG. 6(*b*) exhibits the total length, being shorter than FIG. 6(*a*). Accordingly, the arrangement of solution feeding pipes 43 become easy.

The adjustment of the solution feeding volume is conducted by a single inkjet head 31. The optimum setting of the solution feeding volume is conducted by the same way as adjusting example 1. The determined length of the pipe is applied to other inkjet heads 31, whereby the optimum back-pressure of the coating solution in each inkjet head can be obtained. Since the adjustment in each inkjet head 31 becomes unnecessary, the number of man-hour for the adjustment is decreased, and the adjusting work becomes simple.

Adjustment Example 3

When the length of solution feeding pipes 43 differs, the inner diameter of pipes 43 may also changed, based on the length of each solution feeding pipe 43, using formula 1, so that the flow resistance of solution feeding pipes 43 can be set to an equal resistance, that is, the solution to be fed can be set to an equal volume. For example, if pipe length L is multiplied by value X, the inner diameter is multiplied by $X^{1/4}$, then the flow resistance is set to be equal. This means that the longer the pipe length becomes, the larger the inner diameter is required. In this case, each pipe is made of a common material.

Figure 7:
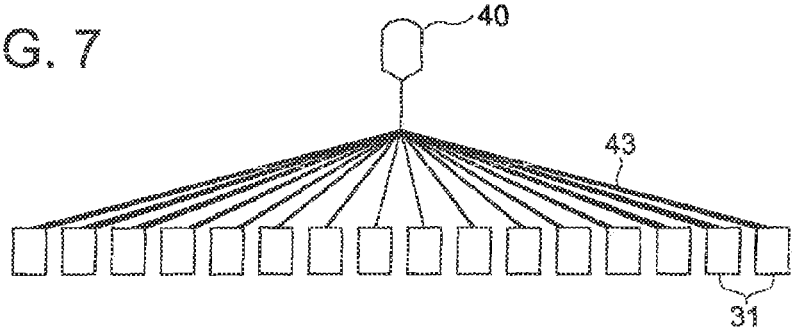
FIG. 7 is a schematic drawing to show an example of the piping pattern, exhibiting different inner diameters, in accordance with the length of the piping patterns.

FIG. 7 is a schematic drawing to show an example of the piping pattern, exhibiting different inner diameters, in accordance to its length within the piping pattern. That is, a shorter pipe is used for inkjet head 31, which is near pressure adjusting mechanism 40, while a longer pipe is used for inkjet head 31, which is farther away from pressure adjusting mechanism 40, and the inner diameter is determined to larger, based on the length of the pipe. Though various diameters are used for solution feeding pipes 43, the length of pipes toward each inkjet head is determined to be optimum, so that any installing problem, including determination of the piping pattern, becomes simplest.

Concerning adjustment of the volume of solution to be fed, it is adjusted by a single inkjet head 31. The optimum setting of its volume is determined based on adjustment example 1. Based on the pipe length and the inner diameter, determined by this, an inner diameter is calculated for each pipe length for each inkjet head 31, while using formula 1, so that the obtained inner diameter is used. Accordingly, no individual inkjet head 31 needs to be adjusted. Since the adjustment in each inkjet head 31 becomes unnecessary, the number of man-hour for the adjustment is decreased, and the adjusting work becomes simple.

Figure 8:
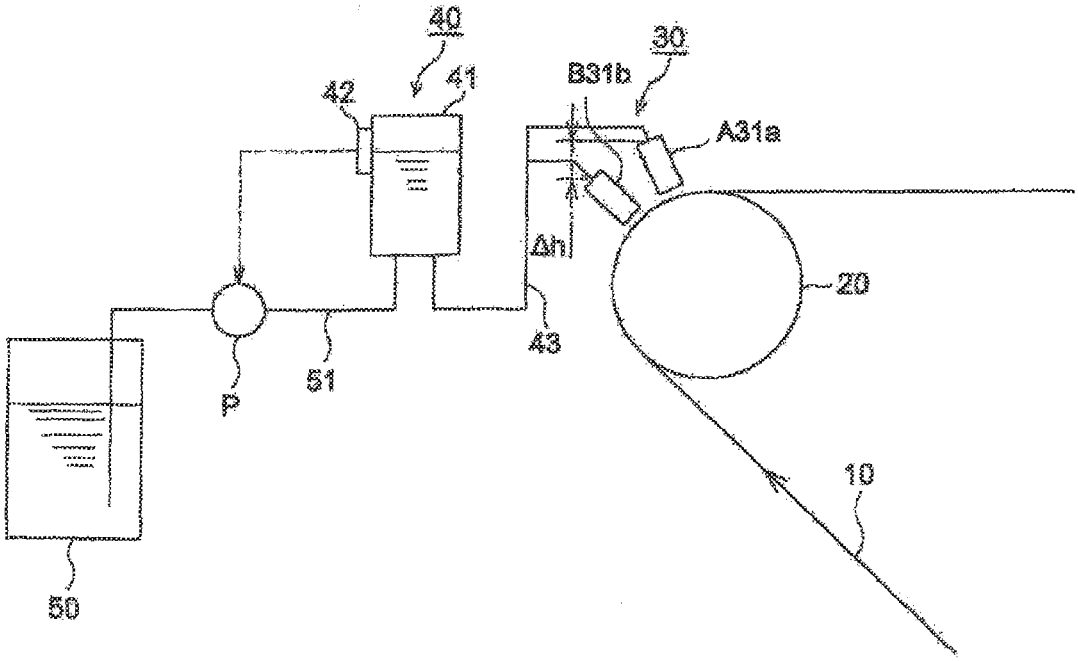
FIG. 8 shows an example, in which a supporting body is supported by a backing roller, and the coating operation is conducted above the backing roller.

When the coating operation is to be conducted by the inkjet head, jetting of the coating solution onto the continuously conveyed strip supporting body, the coating operation is preferably conducted on said supporting body, entrained about the backing roller, because the clearance between the supporting body and the inkjet head is stably secured. FIG. 8 shows an example for conducting the coating operation onto supporting body 10 by inkjet head 31, while supporting body 10 is secured by backing roller 20.

In FIG. 2, all of inkjet heads 31 are mounted at the same height compared to pressure adjusting mechanism 40, while in FIG. 8, staggered inkjet heads 31 are mounted at the different height in each of lines in the width direction of the supporting body. That is, comparing line A31*a* with line B31*b*, the height of each line differs in the direction of gravitational force.

In order to stably conduct the coating operation shown in FIG. 8, the volume of solution to be fed to the plurality of inkjet heads 31 is necessary to be controlled to be the same, that is, the back-pressure is necessary to be controlled to be the same volume.

Pressure difference $\Delta P_h$, which is caused by the difference between the height of inkjet heads on line A31*a* and the height of line B31*b*, is shown by following formula 2.

$$\Delta Ph=\rho g\Delta h \quad \text{(Formula 2)}$$

where, "ρ" represents the density of the coating solution, "g" represents the gravity acceleration, and "Δh" represents the difference between the height of inkjet heads on line A31*a* and the height of line B31*b* (said difference is shown by Δh in FIG. 8).

Accordingly, in order to cancel any difference of pressure, which is caused by the difference of height, while changing the length of the pipes, the following formula is necessary. That is, formula "$\Delta P=\Delta P_h$," is obtained from (Formula 1) and (Formula 2), which formula results in formula 3, as the relationship to be satisfied.

$$(128\mu\Delta LQ)/(\pi D^4)=\rho g\Delta h \quad \text{(Formula 3)}$$

where, "ΔL" represents increasing and decreasing values of the length of pipe.

Further, in order to cancel any difference of pressure caused by the difference of height, without changing the length of pipe, but changing the diameter of pipe, from (Formula 1) and (Formula 2), Formula 4 is obtained, as the relationship to be satisfied.

$$(128\mu LQ)/(\pi(\Delta D)^4)=\rho g\Delta h \quad \text{(Formula 4)}$$

where, "ΔD" represents increasing and decreasing values of the diameter of pipe.

The adjustment of the volume of solution to be fed, for the embodiment shown in FIG. 8, will now be detailed.

The above detailed (Adjustment Example 1) will also be used in this embodiment.

Adjustment Example 4

While the method detailed in (Adjustment Example 2) is used in the embodiment shown in FIG. 8, any difference between the height of inkjet heads on line A31*a* and the height of line B31*b* is corrected in this example 4.

Firstly, the length of pipe for the inkjet heads on line A31*a* is determined, as described in the above described (Adjustment Example 2). Next, while the length of pipe of the inkjet heads on line A31*a* is used as a standard, an increasing value or decreasing value of the length of pipe, caused by the difference of height of inkjet heads on line B31*b*, is calculated by (Formula 3), whereby the length of pipe of line B31*b* is determined. As shown in FIG. 8, if line B31*b* is mounted lower than line A31*a*, the length of pipe is determined to be longer. In the above explanation, the length of pipe of the inkjet heads on line A31*a* is used as the standard, however the length of pipe of inkjet heads on line B31*b* can also be used as the standard.

By the above method, the back-pressure of the coating solution of each inkjet head 31 can be determined to be the optimum pressure. Further, since the adjustment of each inkjet head 31 thereby becomes unnecessary, the number of man-hours for adjustment is decreased, and the overall adjusting work becomes simple.

Adjustment Example 5

While the method detailed in (Adjustment Example 3) is used in the embodiment shown in FIG. 8, the difference between the height of the inkjet heads on line A31*a* and the height of the inkjet heads on line B31*b* is corrected in Example 5.

Firstly, the volume of solution, to be fed to one of single inkjet head 31 on line A31*a*, is adjusted. The optimum determination of the solution to be fed is in the same way as in the case of (Adjustment Example 1). Based on the length of pipe and the diameter of pipe, determined by said way, the diameter of pipe is calculated by Formula 1, using the length of pipe of other inkjet heads 31. The above calculated diameter is applied to each inkjet head of line A31*a*. Next, for inkjet heads 31 of line B31*b*, increasing or decreasing of the diameter of pipe, caused by the difference of height, is calculated by Formula 4, and said increasing or decreasing is added to the above calculated diameter as the correction, whereby the corrected diameter is applied to all inkjet heads 31 on line B31*b*. In the embodiment shown in FIG. 8, the effect, being the same as Adjustment Example 3, is realized.

Though the volume of the solution to be fed to inkjet head 31 is adjusted by the above detailed adjustment examples, other variations may still occur in the ink jetting performance of each inkjet head 31. The difference can be reduced by voltage adjustment to the individual piezoelectric elements. Such voltage adjustment is conducted by a method in which after inkjet head 31 is assembled, the jetting volume of each inkjet head 31 is measured, while the voltage is changed for the piezoelectric element. As another method, after the actual coating operation is conducted, the thickness of the coated film is measured, and the voltage, applied to each respective piezoelectric element, is then adjusted so that the desired thickness of the coated film can be obtained.

Accordingly, by adjusting the volume of solution to be fed, and to be an equal and appropriate volume, it is possible to make the back-pressures of the coating solution applied to the plurality of inkjet heads to be equal. Due to this, when the coating operation is conducted on the long-roll supporting body, being continuously conveyed, the appropriate back-pressure can be applied to the coating solution in the inkjet head, whereby the stable jetting operation of the coating solution can be conducted, as the stable coating operation.

Tested Example

The coating operation is conducted for the coating device shown in FIG. 1, in which the piping patterns shown in FIGS. 4, 6(*a*), and 6(*b*) are used. The variations of the thickness of the coated films are measured, and checked.

1. Production of the Supporting Body

The inventor made cellulose solution (being dope solution), using cellulose esters, plasticizing agents, ultraviolet absorbers, fine particles, and solvents. The inventor produced a cellulose ester film, exhibiting 1500 mm width, 80 μm thickness, and 3000 m length, by the solution casting film forming method.

2. Production of the Coating Solution

The inventor produced a coating solution for the hard-coating work, using the following compositions.

| | |
|---|---|
| cryl monomer; KAYARAD DPHA (dipentaerythritol hexaacrylate) (Nippon Kayaku Co., Ltd.): | 170 mass parts |
| trimethylolpropanetriacrylate: | 30 mass parts |
| photo polymerization initiator (irgacure 184 (Ciba Speciality Chemicals Co., Ltd.)): | 10 mass parts |
| propylene glycol monomethyl ether: | 100 mass parts |
| acetic ether: | 100 mass parts |
| oil-shedding surface-active agent (polydimethylsiloxane; KF96 (Shin-Etsu Chemical Co., Ltd.)): | 0.5 mass part |

3. Production of the Coated Film

The inventor coated the coating solution, produced in item 2, on the cellulose ester film, produced in above step 1, while using the inkjet method, so that the inventor produced a hard-coated film.

The inventor used line-type inkjet unit 30, including piezo element-type inkjet heads 31, having 512 nozzles, each exhibiting diameter of 27 μm, and nozzle pitch of 70 μm. Forty inkjet heads 31 are staggered across the width of the supporting body, so that each inkjet head 31 can jet the coating solution with no space between. Said staggered arrangement includes two lines, and each line includes 20 inkjet heads 31. Heat insulation and warming (at 40° C.) were provided between solution tank 41 and inkjet heads 31, and the inkjet temperature was 40° C., at a driving frequency of 20 kHz.

Concerning the piping patterns shown in FIG. 4, solution feeding pipes 43 are determined for each inkjet head 31, to be simple arranging lengths. Further, concerning the back-pressure, the pressure activated by pressure adjusting mechanism 40 was controlled so that the back-pressure for inkjet head 31, positioned at the farthest end of FIG. 4, and having the longest pipe length among solution feeding pipes 43, was adjusted to 14 [pl] in the present example.

Still further, concerning the piping patterns shown in FIGS. 6(*a*) and 6(*b*), the pressure activated by pressure adjusting mechanism 40 was controlled so that the back-pressures for inkjet heads 31, positioned at the farthest end of FIGS. 6(*a*) and 6(*b*), and having the longest pipe length among solution feeding pipes 43, were adjusted to 14 [pl] in the present example. Subsequently, the piping works were conducted for remaining inkjet heads 31, being other than the farthest inkjet heads 31, with the same length as the farthest ones.

Still further, the supporting body carrying the jetted coating solution is dried at 100° C. by dryer section 100, which is provided downstream of the coating section, after that said supporting body is heated by ultraviolet rays exhibiting lighting intensity 0.1 W/cm$^2$, and the irradiance level of 0.2 J/cm$^2$, so that the jetted coating solution was hardened on the supporting body. Due to these operations, the dried coated film exhibiting a thickness of 5 μm was formed on the supporting body.

4. Measurement of the Variation of Thicknesses of the Coated Film

The inventor measured the thickness of the coated portions, coated by 40 inkjet heads 31. That is, for each inkjet head 31, the thickness was measured at 10 points at 2 mm interval, across the width of the supporting body. After the averaged thickness is calculated for each inkjet head 31, the averaged thickness of the portion coated by each inkjet head 31 was obtained. Among these averaged thickness, the maximum and minimum averaged thickness were selected. The difference between them was divided by the average thickness of the total measured thicknesses, and a resulted value is represented by "A", being referred to as the variation of the thickness. To measure the thickness, optical interferotype thickness meter, FE-3000, was used, produced by Otsuka Electronics Co., Ltd.

5. Checking the Variations of the Thickness

The results of checking are listed below.

| | |
|---|---|
| $A \leq 0.05$: | best |
| $0.05 < A \leq 0.1$ | good |
| $0.1 < A$ | worst |

6. Checked Results

Table 1 shows the checked results.

TABLE 1

Figure 6A:
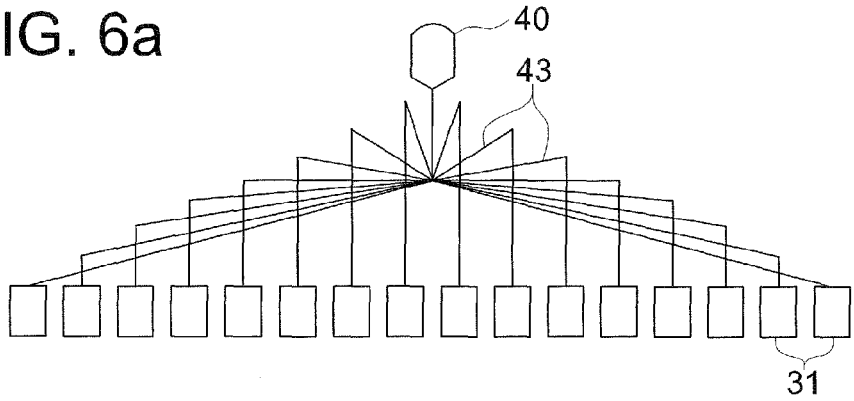
FIG. 6 is a schematic drawing to show an example of the piping pattern, each exhibiting the same piping length.
Figure 6B:
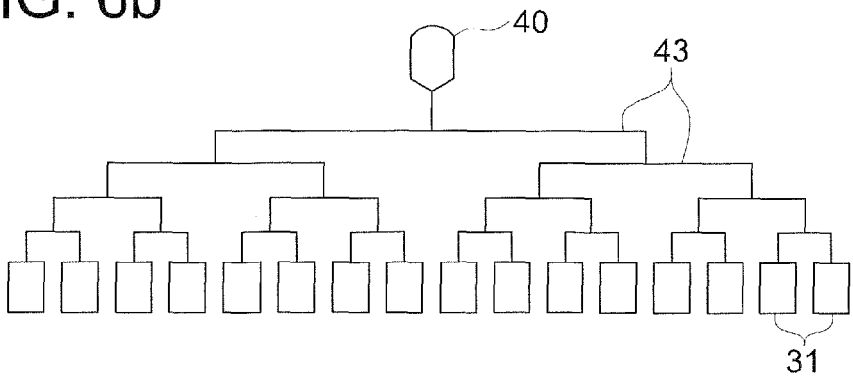

| Piping pattern | Piping distance between the solution feeding pipe and the inkjet head | Variation of thicknesses of coated film | Notes |
|---|---|---|---|
| FIG. 4 | not equal | Worst | Reference |
| FIG. 6a | equal | Good | Tested example |
| FIG. 6b | equal | Good | Tested example |

As shown in Table 1, by making the lengths of pipes between solution feeding tank 41 and inkjet heads 31 to be equal, that is, by making the volume to be fed (or the back-pressure) to be equal, the variations of the coated thickness can be controlled to be less than a predetermined value.

What is claimed is:

1. A coating device, using an inkjet method to jet droplets of a coating solution onto a long-roll supporting body, which body is continuously conveyed, and forming a coated film thereon, the coating device comprising:

a plurality of inkjet heads which are arranged to cover an area to be coated in a width direction of the long-roll supporting body;

a pressure adjusting mechanism which is configured to adjust back-pressure of the coating solution in the plurality of inkjet heads;

a plurality of solution feeding pipes which supply the coating solution from the pressure adjusting mechanism to the plurality of the inkjet heads; and a storage tank which is configured to store the coating solution, wherein in the plurality of solution feeding pipes, connected to the plurality of inkjet heads, a feeding volume of coating solution in each pipe is adjusted to be equal, and wherein the plurality of inkjet heads are arranged at different heights compared to the pressure adjusting mechanism, in each line of a staggered arrangement in the width direction of the long-roll supporting body, and the lengths of the solution feeding pipes are configured to differ each other in each line of the inkjet heads.

2. The coating device of claim 1, wherein a diameter of each of the solution feeding pipes is determined based on a length of the solution feeding pipe which is measured from the pressure adjusting mechanism to the inkjet head, and further determined based on a height of each line of the staggered arrangement of the inkjet heads.

3. The coating device of claim 1, wherein the pressure adjusting mechanism includes a solution feeding pipe to temporarily keep the coating solution, so that the pressure adjusting mechanism controls the back-pressure of the coating solution in the inkjet head, by an adjustment of the height of coating solution in the solution feeding tank.

4. The coating device of claim 1, wherein the pressure adjusting mechanism includes the solution feeding tank to temporarily keep the coating solution, and controls an air pressure in the solution feeding tank, so that the pressure adjusting mechanism controls the back-pressure of the coating solution in the inkjet head.

5. The coating device of claim 1, wherein the pressure adjusting mechanism controls a solution feeding pump, which is provided on the solution feeding pipe to supply coating solution, from the solution storage tank to each inkjet head, so that the pressure adjusting mechanism controls the back-pressure of the coating solution in the inkjet head, while using the solution feeding pump.

6. A coating device, using an inkjet method to jet droplets of a coating solution onto a long-roll supporting body, which body is continuously conveyed, and forming a coated film thereon, the coating device comprising:

a plurality of inkjet heads which are arranged to cover an area to be coated in a width direction of the long-roll supporting body;

a pressure adjusting mechanism which is configured to adjust back-pressure of the coating solution in the plurality of inkjet heads;

a plurality of solution feeding pipes which supply the coating solution from the pressure adjusting mechanism to the plurality of the inkjet heads; and a storage tank which is configured to store the coating solution, wherein in the plurality of solution feeding pipes, connected to the plurality of inkjet heads, a feeding volume of coating solution in each pipe is adjusted to be equal, and wherein a diameter of each of the solution feeding pipes is determined based on a length of each of the solution feeding pipes which are from the pressure adjusting mechanism, to the inkjet heads.

7. The coating device of claim 6, wherein the pressure adjusting mechanism includes a solution feeding pipe to temporarily keep the coating solution, so that the pressure adjusting mechanism controls the back-pressure of the coating solution in the inkjet head, by an adjustment of the height of coating solution in the solution feeding tank.

8. The coating device of claim 6, wherein the pressure adjusting mechanism includes the solution feeding tank to temporarily keep the coating solution, and controls an air pressure in the solution feeding tank, so that the pressure adjusting mechanism controls the back-pressure of the coating solution in the inkjet head.

9. The coating device of claim 6, wherein the pressure adjusting mechanism controls a solution feeding pump, which is provided on the solution feeding pipe to supply coating solution from the solution storage tank to each inkjet head, so that the pressure adjusting mechanism controls the back-pressure of the coating solution in the inkjet head, while using the solution feeding pump.

* * * * *